United States Patent [19]

Karesh

[11] 4,078,686

[45] Mar. 14, 1978

[54] TWO-WAY JAR

[76] Inventor: Myrna M. Karesh, 245 E. 180 St. Apt. 2C, Bronx, N.Y. 10457

[21] Appl. No.: 756,801

[22] Filed: Jan. 5, 1977

[51] Int. Cl.[2] ..... B65D 25/14

[52] U.S. Cl. ..... 215/6; 215/12 R

[58] Field of Search ..... 215/6, 12 R, 13 R; 220/17, 20; 206/538

[56] References Cited

U.S. PATENT DOCUMENTS

| | | | |
|---|---|---|---|
| 378,752 | 2/1888 | Ader | 215/6 |
| 2,575,283 | 11/1951 | Menrath | 215/12 R |
| 2,938,518 | 5/1960 | Horrocks | 215/6 UX |
| 3,465,905 | 9/1969 | Schottanes | 215/6 |

*Primary Examiner*—Donald F. Norton
*Attorney, Agent, or Firm*—Charles J. Speciale

[57] ABSTRACT

A two-way jar with removable inserts comprising a cylindrical container divided into a first compartment and a second compartment, the inserts removably placeable in each compartment and separate access means into each compartment.

6 Claims, 2 Drawing Figures

TWO-WAY JAR

BACKGROUND OF THE INVENTION

1. Field of the Invention

This invention relates to a two-way jar with removable inserts.

2. Description of the Prior Art

Two-way or two-in-one assemblies are known. For example, U.S. Pat. Nos. 3,327,881 and 3,465,905 disclose dual or multiple vacuum bottle containers. However, it is a problem with these that not only are the vacuum bottles breakable but they are also not removable or replaceable. Other patents such as U.S. Pat. Nos. 2,687,231 and 2,836,323 disclose stacking devices or tandem container assemblies but they do not disclose a two-way jar with removable inserts and separate access means into each part of the jar.

SUMMARY OF THE INVENTION

It is, therefore, among one of the principal objectives of this invention to provide a two-way jar not known to the prior art.

In accord with the invention there is now provided a two-way jar with removable (and disposable, if desired) inserts comprising a cylindrical container divided into a first and second compartment, said inserts removably placeable in each compartment and separate access means into each compartment. The compartments may be of the same or different sizes as may be the inserts.

BRIEF DESCRIPTION OF THE DRAWING

The invention may be hereinafter more fully described with reference to the accompanying drawing in which.

DESCRIPTION OF THE PREFERRED EMBODIMENTS

Figure 1:
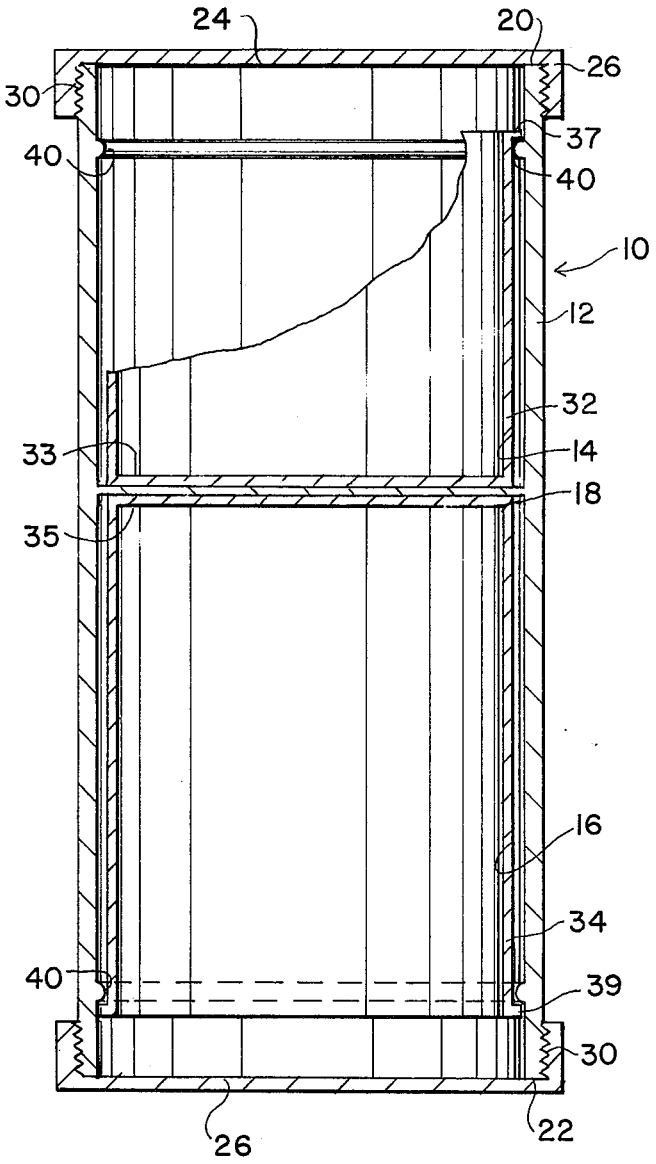
FIG. 1 is an elevated plan view of the two-way jar of the invention with part of the jar wall cut away.
Figure 2:
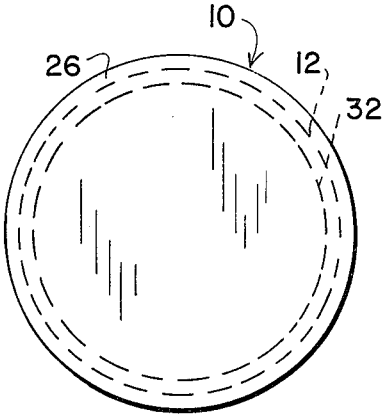
FIG. 2 is a top plan view of the invention device shown in FIG. 1.

Referring now to the figures of the drawing, there is illustrated therein the two-way jar 10 of the invention. Two-way jar 10 comprises a cylindrical, preferably clear plastic or glass, container 12 provided with separate superimposed cylindrical first and second compartments 14 and 16, respectively, divided by a common wall 18. Each end of the container, divided arbitrarily into an upper end 20 and lower end 22, has an opening 24 and 26, respectively, in the first and second compartments 14 and 16, respectively. A screw cap 26 (metal or plastic) is provided at each said end of the container. Of course, the outside walls of the ends are associatingly threaded to accommodate the screw caps 26, as at threaded portions 30. The screw caps, when in place, removably seal the first and second compartments.

As a critical feature of the invention, removable cylindrical inserts 32 and 34 made similarly of clear plastic or glass as the container 12, are provided to slide concentrically into the first and second compartments, respectively.

Cylindrical inserts 32 and 34 are closed at one end 33 and 35, respectively, which ends are restably abuttable against common divider wall 18. An outwardly extending rim 37 and 39 can be provided, respectively, at the other ends of the inserts. These rims 37 and 39 are adapted to rest on circular ridges 40 provided at the upper inside walls of the inserts 32 and 34.

The first and second compartments may be of the same size (length) and accommodate suitably sized inserts therein. However, the compartments may differ in length so as to hold smaller or larger volumes of materials. The two-way jar of the invention may be used for foodstuffs such as jams, jellies, peanut butter or the like. For example, the first compartment may have peanut butter and the second compartment, jelly. Or, the first compartment may hold strawberry preserves and the second compartment, apricot preserves. The combinations are innumerable, e.g., vegetables, cereals, macaroni. Moreover, the jar may be used to hold hardware items such as nuts, bolts, screws of varying sizes, nails, picture hooks, and so forth.

As earlier described the inserts may be removable. They may also be disposable so that the manufacturer can supply filled inserts for sale with empty two-way jars. When the jars are inverted for desired use, of course, the screw cap on the non-used end will seal in the contents of that particular end of the jar.

What is claimed is:

1. A two-way jar with removable inserts comprising a cylindrical container divided into a first compartment and a second compartment, said inserts being adapted to be removably placeable in each said compartment and separate access means into each said compartment, wherein said first compartment is superimposed over said second compartment, said compartments being divided by a common wall, said first and second compartments being cylindrically shaped, open at one end and closed at the other by said common wall, said inserts being associatingly cylindrically shaped and having a closed end and an open end for removable concentric insertion into each said compartment and restable against said common wall by their closed end, said separate access means comprising the open ends of each said compartment forming an opening into each said compartment, each opening being adapted to be openably closeable to provide access into said inserts.

2. A two-way jar according to claim 1 wherein each said opening is adapted to be threadingly openably closeable by means of a screw cap, the open ends of each said compartment being associatingly threaded with said screw cap.

3. A two-way jar according to claim 1 wherein said compartments have a different volume.

4. A two-way jar according to claim 1 wherein said compartments are of substantially the same volume.

5. A two-way jar according to claim 1 wherein said container and said inserts are formed of a clear material.

6. A two-way jar according to claim 1 wherein said container and said inserts are formed of a clear material.

* * * * *